United States Patent [19]

Walty

[11] 4,314,231

[45] Feb. 2, 1982

[54] CONDUCTIVE POLYMER ELECTRICAL DEVICES

[75] Inventor: Robert J. Walty, Redwood City, Calif.

[73] Assignee: Raychem Corporation, Menlo Park, Calif.

[21] Appl. No.: 141,990

[22] Filed: Apr. 21, 1980

[51] Int. Cl.[3] ..... H01C 1/14

[52] U.S. Cl. ..... 338/328; 338/25; 338/212; 338/334

[58] Field of Search ..... 338/328, 25, 22 R, 322–325, 338/327, 329, 334, 225, 314, 320, 204, 211, 212, 260; 219/505, 510, 548, 549, 553; 29/612, 613; 427/103

[56] References Cited

U.S. PATENT DOCUMENTS

| | | | |
|---|---|---|---|
| 2,278,072 | 3/1942 | Gould et al. | 338/328 |
| 2,961,522 | 11/1960 | Hammer | 219/541 |
| 3,237,286 | 3/1966 | Ebling, Jr. et al. | 338/322 X |
| 3,344,385 | 9/1967 | Bartos et al. | 338/331 X |
| 3,351,882 | 11/1967 | Kohler et al. . | |
| 3,385,959 | 5/1968 | Ames et al. | 338/211 X |
| 3,683,361 | 8/1972 | Salzwedel | 338/322 |
| 3,859,504 | 1/1975 | Motokawa et al. | 219/549 X |
| 4,017,715 | 4/1977 | Whitney et al. | 338/22 R X |
| 4,177,376 | 12/1979 | Horsma et al. | 338/212 X |

FOREIGN PATENT DOCUMENTS 1167551 10/1969 United Kingdom .

*Primary Examiner*—C. L. Albritton
*Attorney, Agent, or Firm*—Lyon & Lyon

[57] ABSTRACT

A method of attaching power leads to a mesh or similar electrode embedded in the surface of a conductive polymer element. A conductor, preferably also mesh, is bonded to the electrode using a conductive adhesive and a polymer layer is applied over the surface of at least the conductor, preferably also over the electrode. The polymer of the coating interpenetrates the openings of the mesh conductor and mesh electrode and bonds to the conductive polymer matrix. This mechanically holds the conductor, electrode, and conductive element in contact with each other.

26 Claims, 2 Drawing Figures

CONDUCTIVE POLYMER ELECTRICAL DEVICES

BACKGROUND OF THE INVENTION

1. Field of the Invention

This invention relates to electrical devices comprising conductive polymer compositions and to a method or attaching power leads to conductive polymer elements.

2. Discussion of the Prior Art

Electrical devices, such as for example, heaters and current limiting devices, comprising conductive polymer compositions are described in the literature and are commercially available.

In such devices a conductive polymer composition is attached in some manner to a source of electrical power. This is generally provided by what is referred to in the art as an electrode which is in contact with the conductive polymer composition and which is connected to a source of electrical power. One type of electrode that can be used with conductive polymer compositions is a wire mesh or grid electrode at least partially embedded in the conductive composition. The grid or mesh must then be attached to a power lead in some fashion. Several techniques for attaching such leads have been suggested. One method comprises soldering or welding power leads to a portion of the mesh which extends beyond the edge of the conductive polymer element. Because of this extension, production of heaters by a continuous extrusion process is limited to substantially rectangular heaters. Also, protruding edges of the mesh electrode are difficult to cut to the desired size. Attachment of a power lead to the center of the mesh by welding or soldering creates a protrusion on the planar surface of the heater making direct contact between the entire heater surface and the surface of the object to be heated difficult or impossible to maintain.

A discussion of attaching electrodes to conductive polymer compositions can be found in U.S. Pat. No. 3,351,882 (Kohler et al.) and U.K. Pat. No. 1,167,551 (Texas Instruments). In the U.K. patent, perforated electrodes are maintained in good electrical contact with a PTC element of a heater by an insulating sleeve. The material of the sleeve and PTC element coalesce in the perforations to maintain this contact. Electrical leads can be connected to the electrodes by any suitable manner, as by peeling away a portion of the outer jacket and soldering the leads to the perforated electrode strips. As mentioned above, soldering leads to electrodes of this type is frequently undesirable.

SUMMARY OF THE INVENTION

This invention provides an improved method of attaching electrical power leads to an electrical device comprising a conductive polymer element. One aspect of this invention provides an electrical device comprising:

(a) a conductive polymer element comprising conductive particles dispersed in a polymer matrix;

(b) an electrode having a plurality of openings therein secured to the surface of said element;

(c) a conductor having a plurality of openings superimposed over at least a portion of said electrodes and conductive element and bonded thereto with an electrically conductive adhesive; and (d) a layer of polymeric material covering said conductor and interpenetrating the openings of said conductor and electrode, said polymeric material bonding to said conductive element, electrode and conductor, thereby retaining said conductor in electrical contact with said electrode and conductive element.

Another aspect of this invention comprises a method of attaching electrical power leads to an electrical device comprising a conductive element composed of a conductive polymer composition comprising conductive particles dispersed in a polymer matrix which comprises:

(a) securing an electrode having a plurality of openings to the surface of said element;

(b) superimposing a conductor having a number of openings therein over at least a portion of said electrode, said conductor being coated with an electrically conductive adhesive on at least the surface thereof which contacts said electrodes;

(c) applying a layer of polymeric material over said conductor so that said polymeric material interpenetrates the openings of said conductor and electrode and bonds to the polymeric matrix of said conductive element, thereby retaining said conductor in good electrical contact with said electrode and conductive element; and (d) attaching a power lead to said conductor.

DETAILED DESCRIPTION OF THE INVENTION

Figure 1:
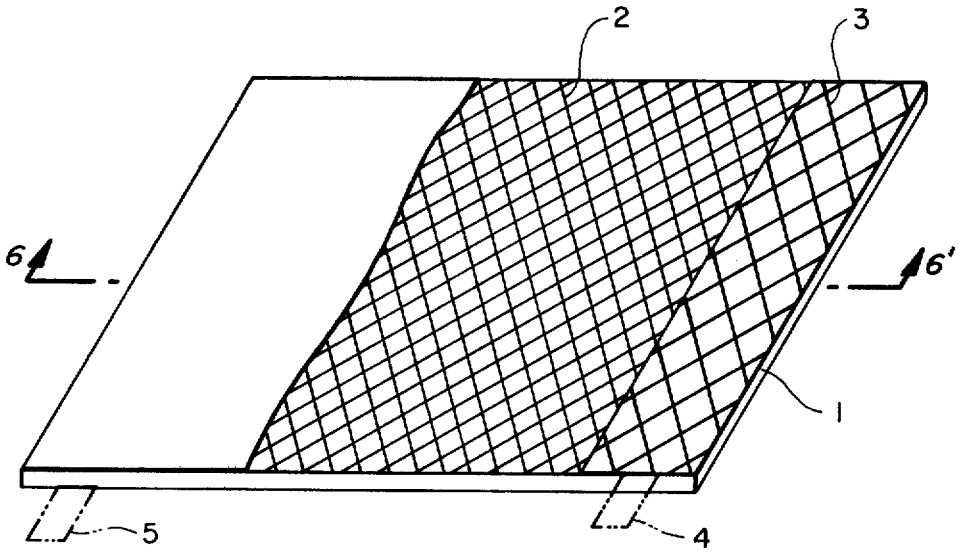
FIG. 1 illustrates a sheet heater having a mesh electrode and mesh conductor secured thereto with conductive adhesive. For purposes of illustration, the polymeric layer over the conductor and electrode has been omitted from the drawing.

Conductive polymer compositions and their use in electrical devices are well known in the art. For example, see U.S. Pat. Nos. 2,978,665 (Vernet et al), 3,243,753 (Kohler), 3,311,862 (Rees), 3,351,882 (Kohler et al), 4,017,715 (Whitney et al) and 4,177,376 (Horsma et al) and copending and commonly assigned Applications Ser. Nos. 750,149 (Kamath et al), 751,095 (Toy et al) 798,154 (Horsma) 943,659 (van Konynenburg), 965,343 (van Konynenburg et al) now U. S. Pat. No. 4,237,441, 965,344 (Middleman et al) now U.S. Pat. No. 4,238,812 and 365,345 (Middleman et al), and applications filed concurrently herewith, now Ser. Nos. 141,984 and 141,988 respectively, the disclosures of which are incorporated herein by reference. In general, these compositions comprise conductive particles of, for example, carbon black, graphite or particulate metal, dispersed in an polymer matrix.

The conductive element used in the practice of this invention can comprise one or more layers of conductive polymer composition. When more than one layer is included in the element, the conductive polymer composition of each layer can be different, if desired. For example, conductive devices comprising layers of different conductive polymer compositions are disclosed in U.S. Pat. No. 4,177,376 (Horsma et al). As described in this patent, conductive polymer compositions can remain of relatively constant wattage, or resistance, with increasing temperature or can exhibit a positive temperature coefficient of resistance (PTC) and undergo a sharp increase in resistance at a given temperature or temperature range with a corresponding decrease in power. In the electrical devices used in accordance with this invention, the conductive element can comprise one or more layers of constant wattage material, i.e. material which exhibits a zero temperature coefficient of resistance (ZTC), PTC material or NTC material, i.e. material which exhibits a negative temperature coefficient of resistance. The conductive element can be a shaped article other than a layer or layered structure, if desired.

The electrode having a number of openings therein is of a highly conductive material. Preferably the electrode is a metal, for example, nickle or nickel coated copper. The electrode is preferably a mesh of metal wire or filaments. Other structures having openings therein such as grids, expanded metal, stranded wire, wire rovings, silver coated nylon fabric, graphite fabric or mats, and the like can be used. The electrode is embedded in or otherwise attached to the conductive element over at least a portion of the surface thereof. Generally, the conductive element is a layered structure and the electrode is embedded over substantially all of at least one surface of the layered structure. In a preferred embodiment, the device comprises two electrodes embedded in opposing surfaces of a layered conductive element.

Preferably, the electrode is embedded in the surface such that conductive polymer composition substantially fills the openings in the electrode. To ensure good electrical contact with the conductor and electrode, the outer surface of the embedded electrode should be free of conductive polymer composition. If necessary, conductive polymer can be removed from the outer surface of the electrode by scraping, sanding or otherwise abrading the surface over the portion of the surface of the electrode which will be in contact with the conductor.

The conductor is also of a highly conductive material and has a plurality of openings therein. The conductor can be a mesh, grid, stranded wire, wire rovings, expanded metal, graphite fabric and mats, and the like. The conductor contacts at least a portion of the electrode. To ensure and maintain good electrical contact between the conductor and electrode, these two components are bonded together with an electrically conductive adhesive. The electrically conductive adhesive is preferably resilient and provides a mechanical buffer between the conductor and electrode, enabling good electrical contact to be maintained over numerous thermal cycles with repeated expansion and contraction of the conductive polymer matrix. The adhesive also provides greater area of contact between the conductor and electrode at each point of intersection between these components, thus preventing burn out which generally occurs at such point contacts. It is believed that openings in the conductor as well as the electrode enable them to remain in electrical contact during repeated expansion and contraction through successive heating cycles. Use of a mechanically resilient electrically conductive adhesive is thought to further improve maintenance of good electrical contact between these two elements.

Electrically conductive adhesives typically contain conductive particles such as carbon black, graphite or powdered metals, for example silver or other high conductive metal dispersed in an adhesive such as, an epoxy, silicone, or preferably, a fluoroelastomer based adhesive. The conductive adhesive provides an interface between the electrode and conductor at the points of intersection between them. However, the adhesive should not fill a substantial proportion of the openings of the conductor or electrode. One convenient method of applying the adhesive to the interface is to apply the adhesive to one side of the conductor such that the majority of the openings of the conductor are not filled with adhesive and then placing the conductor over the electrode. The adhesive can be applied to the conductor by, for example, spraying, brushing, roll-coating, dipping, etc.

The conductor is attached to lead wires which can be connected to a source of electrical power. This can be accomplished, for example, by positioning the conductor in a manner such that a portion thereof extends beyond the edge of the conductive element and securing a connecting wire to the extended portion. This can be done by soldering, welding or otherwise physically and electrically connecting the lead wire to the conductor. When the lead wire is connected to a source of power, current flows through the conductor, electrode and conductive element.

An outer layer of polymeric material covers at least the conductor and interpenetrates the openings of the conductor and electrode and bonds to the polymer matrix of the conductive element. This mechanically holds the conductor, electrode, and conductive element in contact with each other. The polymer used should be capable of bonding to the polymer of the conductive polymer matrix. The outer polymer layer preferably covers the entire surface of the device. For many uses the polymer layer should be an insulating layer. However, in some cases it is desirable that the outer layer also be conductive. For example, in manufacturing a multilayered conductive element with mesh electrodes interspersed between the conductive layers. One to these layers can be considered as an outer polymer layer. In this case, the polymeric material can be of the same of a different conductive polymer composition, as long as the polymer matrices of the layers are compatible. The entire device does not need to be covered by the polymer layer, for example, when the device is to be later incorporated into an apparatus or appliance, the insulation can be placed only over the conductor where it makes contact with the electrode. The polymeric material can be, for example, a polyolefin such as polyethylene or polypropylene, polyvinylidene chloride, polyvinylidene fluoride, polytetrafluoroethylene, polychlorotrifluoroethylene, tetrafluoroethylene-hexafluoropropylene copolymer, vinylidene fluoride-hexafluoropropylene copolymer, epoxy resin, polyurethane, silicone rubber or the like. The polymeric layer can be applied over the conductor or entire surface of the device by conventional techniques such as compression molding, extrusion, lamination, adhesive bonding, etc.

Turning now to the drawings, FIG. 1 illustrates an embodiment of the invention. FIG. 1 shows a sheet heater composed of a conductive polymer layer, 1, having embedded in the surface thereof, a mesh electrode, 2. A mesh conductor, 3, in the form of a strip is secured to the embedded mesh electrode, 2, with a conductive adhesive. Power lead, 4, is soldered to the mesh conductor, 3. In this embodiment a second electrode (not shown) identical to the first is attached to the opposite side of the heater and power lead, 5, extends from a conductor (not shown) identical to conductor, 3, but secured to the second electrode.

Figure 2:
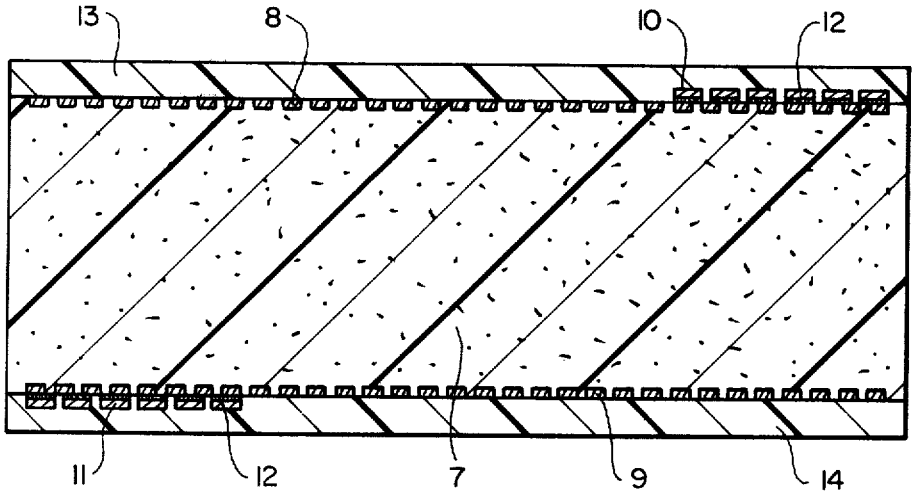
FIG. 2 is a cross-section of the heater of FIG. 1 along the line 6—6'. In this drawing the polymeric covering has been included.

FIG. 2 shows an enlarged view of a cross-section of the heater of FIG. 1 along the line 6-6'. In FIG. 2, the conductive polymer layer, 7, has mesh electrodes, 8 and 9, embedded on opposing surfaces thereof. Mesh conductors, 10 and 11, are bonded to electrodes, 8 and 9, respectively with electrically conductive adhesive, 12, which coats the solid segments of the mesh conductors, 10 and 11. Polymeric insulating layers, 13 and 14, cover both opposing surfaces of the heater and interpenetrate the openings of the mesh conductors, making contact with and bonding to the conductive polymer matrix.

EXAMPLE

This example further illustrates the invention. In this example a planar heater having mesh electrodes was prepared and power leads were connected thereto in accordance with the invention. The planar heater comprises planar mesh electrodes having between them a conductive polymer layer which exhibits a positive temperature coefficient of resistance (PTC) and a contiguous layer which exhibits essentially no change of resistance with changing temperatures (ZTC or zero temperature coefficient of resistance). The conductive composition used to prepare the ZTC layer is the subject of copending commonly assigned patent application, Ser. No. 141,984, filed concurrently herewith.

PREPARATION OF ZTC SHEET MATERIAL

Master Batch 1 was prepared from the ingredients shown in the Table. The ingredients were introduced into a 25 lb. Banbury mixer whose rotor had been preheated by steam and was turning at high gear. When the torque had increased considerably, the steam to the rotor was turned off and water was passed through the rotor to cool it. Mixing was continued at fourth gear for 2.5 mins. after the water had been turned on and for a further 2 mins. at third gear. The mixture was dumped, held on a steam-heated mill, extruded into a water bath through a 3.5 inch extruder fitted with a pelletizing die, and chopped into pellets. The pellets were dried under vacuum at 60° C. for at least 18 hours.

Master Batch 2 was prepared from the ingredients shown in the Table. The ingredients were introduced into a 25 lb. Banbury mixer whose rotor was water-cooled and was turning at high gear; mixing was carried out at fourth gear for 2 mins. and at third gear for 1.75 mins. The mixture was dumped, cooled and granulated. The granules were dried under vacuum at 60° C. for at least 18 hours.

The final mix, containing the ingredients shown in the Table, was prepared by introducing 11,523 g. of Master Batch 1, 3,127 g. of Master Batch 2, 3,480 g. of high density polyethylene (Marlex 6003) and 77.7 g. of antioxidant into a 25 lb. Banbury mixer whose rotor was water-cooled and was turning at high hear; mixing was carried out at high gear for 4 mins. and at low gear for 1 min. The mixture was dumped, held on a steam-heated mill, extruded into a water bath through a 3.5 inch extruder fitted with a pelletizing die, and chopped into pellets. The pellets were dried under vacuum at 70° C. for 24 hours, and then extruded into sheet 12 inches wide and 0.021 inch thick, using a two and one half inch Davis-Standard Extruder fitted with a 15 inch sheet die and operating at 20 RPM with a throughput of 4 feet/-minute. The sheet was stored under argon.

PREPARATION OF PTC SHEET MATERIAL

The ingredients shown in the Table for the PTC material were introduced into a 25 lb Banbury mixer. The mixture was dumped from the Banbury and converted into sheet by the same procedure as the Final Mix. The sheet was stored under argon.

PREPARATION OF HEATER

Rectangles 8.75×9 inch were cut from the ZTC sheet material and from the PTC sheet material, and dried under vacuum at 60° C. for 9 hours. Two rectangles 8×9 inch were cut from a sheet of fully annealed nickel mesh that had been thoroughly cleaned. The rectangles were sprayed until the nickel was completely covered, but the mesh apertures were not filled, with a composition containing 60 parts by weight of methyl ethyl ketone and 40 parts of Electrodag 502 which is an adhesive composition comprising graphite particles dispersed in a fluoroelastomer, specifically a copolymer of vinylidene fluoride and hexafluoropropylene. The coated mesh rectangles were dried under vacuum for 2 hours at 100° C.

The PTC, ZTC and mesh rectangles were laminated to each other by layering a fluoroglass sheet (a release sheet of a glass-fiber reinforced fluorinated polymer), a mesh electrode, a PTC layer, a ZTC layer, another mesh electrode, and another fluoroglass sheet in a mold and pressing with a 12 inch press with plate temperatures of (224° C.) (top) and 218° C. (bottom) for 3.5 minutes at 14 tons ram pressure. The mold was then cooled in an 18 inch cold press with air cooling at 14 tons ram pressure for 5 minutes.

ATTACHMENT OF THE POWER LEADS

The resulting heater blank was masked, leaving 1.5 inch at each end unmasked. A razor was used to scrape away PTC or ZTC material (which had been pressed through the coated mesh) from the mesh on opposite sides of the heater in the unmasked area. The scraped area on each side of the heater blank was then further abraded with a grit blaster using 320 mesh grit and 40 pounds per square inch pressure.

Strips 1.0×10.0 inch were cut from flat and fully annealed Cu mesh which had been thoroughly cleaned. One side of the strips was coated with a silver/silicone contact elastomer and strips were then dried in vacuum at room temperature for a minimum of 4 hours. One end of each of the strips was then bent back at a 45° angle and 0.008×0.187×6.0 inch flat Copper wire was soldered onto the bent end. One of these strips was applied to each of the abraded areas of the heater blank with the silver side toward the heater and then each of the conductors was covered with a 8.75×1.5×0.011 inch polyethylene sheet. The assembly was placed between two 0.5 inch aluminum plates and compression molded at 200° C. for 3 min. at 5000 lbs. pressure, and then placed in the cold press for 10 minutes at 5000 lbs. pressure.

TABLE

| | MASTER BATCH 1 | | | MASTER BATCH 2 | | | FINAL MIX | | | PTC | | |
|---|---|---|---|---|---|---|---|---|---|---|---|---|
| | g. | % wt. | % Vol. | g. | % wt. | % Vol. | g. | % wt. | % Vol. | g. | % wt. | % Vol. |
| Carbon Black 1 (Raven 8000) | — | — | — | 6628 | 42.1 | 28 | 1317 | 7.2 | 7.6 | — | — | — |

TABLE-continued

| | MASTER BATCH 1 | | | MASTER BATCH 2 | | | FINAL MIX | | | PTC | | |
|---|---|---|---|---|---|---|---|---|---|---|---|---|
| | g. | % wt. | % Vol. | g. | % wt. | % Vol. | g. | % wt. | % Vol. | g. | % wt. | % Vol. |
| Carbon Black 2 (Furnex N765) | — | — | — | — | — | — | — | — | — | 7001 | 44 | 29.6 |
| Polyethylene 1 (Marlex 6003) | — | — | — | — | — | — | 3480 | 19.1 | 10.7 | 8592 | 54 | 68.1 |
| Polyethylene 2 (Alathon 7050) | 6186 | 27.3 | 49 | 8837 | 56.1 | 70 | 4900 | 26.9 | 15.0 | — | — | — |
| Inert Filler (Glass Beads) | 16306 | 72.1 | 50 | — | — | — | 8308 | 45.6 | 65.9 | — | — | — |
| Antioxidant | 138 | 0.6 | 1 | 276 | 1.8 | 2 | 203 | 1.2 | 0.8 | 318 | 2 | 2.3 |

NOTES:
Raven 8000 (Available from City Services Co.) has a particle size (D) of 13 millimicrons and a surface area (s) of 935 $m^2/g$.
Furnex N765 (Available from City Services Co.) has a particle size (D) of 60 millimicrons and a surface area (s) of 32 $m^2/g$.
Marlex 6003 is a high density polyethylene with a melt index of 0.3 which is available from Phillips Petroleum Co.
Alathon 7050 is a high density polyethylene with a melt index of 18.0 which is available from E.I. DuPont de Nemours & Co.
The glass beads are available from Potters Industries as Potters #3000 with CP-01 coating. They are spherical glass beads with a diameter of 4-44 microns and having a surface coating of a wetting or coupling agent thereon.
The antioxidant used was an oligomer of 4,4-thio bis (3-methyl-6-t-butyl phenol) with an average degree of polymerization of 3-4, as described in U.S. Pat. No. 3,986,981.

What is claimed is:

1. An electrical device comprising:
(a) a conductive polymer element comprising conductive particles dispersed in a polymer matrix;
(b) an electrode having a plurality of openings therein secured to the surface of said element;
(c) a conductor having a plurality of openings superimposed over at least a portion of said electrode and conductive element and bonded thereto with an electrically conductive adhesive; and
(d) a layer of polymeric material covering said conductor and interpenetrating the openings of said conductor and electrode, said polymeric material bonding to said conductive element, electrode and conductor, thereby retaining said conductor in electrical contact with said electrode and conductive element.

2. An electrical device in accordance with claim 1 wherein said electrode is a mesh electrode.

3. An electrical device in accordance with claim 2 wherein said mesh electrode is of nickel.

4. An electrical device in accordance with claim 2 wherein said mesh electrode is embedded in said conductive polymer element.

5. An electrical device in accordance with claim 1 wherein said conductor is a mesh conductor.

6. An electrical device in accordance with claim 5 wherein said mesh conductor is of copper.

7. An electrical device in accordance with claim 1 wherein said electrically conductive adhesive is a resilient adhesive.

8. An electrical device in accordance with claim 1 wherein said electrically conductive adhesive comprises conductive particles dispersed in a silicone elastomer.

9. An electrical device in accordance with claim 8 wherein said conductive particles are of silver.

10. An electrical device in accordance with claim 1 wherein said conductive polymer element comprises carbon black particles dispersed in a polymer matrix.

11. An electrical device in accordance with claim 10 wherein said polymer matrix is selected from the group consisting of polyethylene, ethylene copolymers, polypropylene and polyvinylidene fluoride.

12. An electrical device in accordance with claim 1 wherein said conductive polymer element comprises at least two layers of different conductive polymer compositions.

13. An electrical device in accordance with claim 12 wherein at least one of said layers comprises a conductive polymer composition having a positive temperature coefficient of resistance.

14. A method of attaching electrical power leads to an electrical device comprising a conductive element composed of a conductive polymer composition composed of conductive particles dispersed in a polymer matrix which comprises:
(a) securing an electrode having a plurality of openings to the surface of said element;
(b) superimposing a conductor having a number of openings therein over at least a portion of said electrode, said conductor being coated with an electrically conductive adhesive on at least the surface thereof which contacts said electrode;
(c) applying a layer of polymeric material over said conductor so that said polymeric material interpenetrates the openings of said conductor and electrode and bonds to the polymeric matrix of said conductive electrode and conductive element, thereby retaining said conductor in good electrical contact with said electrode and conductive element; and
(d) attaching power leads to said conductor.

15. A method in accordance with claim 14 wherein said electrode is a mesh electrode.

16. A method in accordance with claim 15 wherein said mesh electrode is of nickel.

17. A method in accordance with claim 15 wherein said mesh electrode is embedded in said conductive polymer element.

18. A method in accordance with claim 14 wherein said conductor is a mesh conductor.

19. A method in accordance with claim 18 wherein said mesh conductor is of copper.

20. A method in accordance with claim 14 wherein said electrically conductive adhesive is a resiliant adhesive.

21. A method in accordance with claim 14 wherein said electrically conductive adhesive comprises conductive particles dispersed in a silicone elastomer.

22. A method in accordance with claim 21 wherein said conductive particles are of silver.

23. A method in accordance with claim 14 wherein said conductive polymer element comprises carbon black particles dispersed in a polymer matrix.

24. A method in accordance with claim 23 wherein said polymer matrix is selected from the group consisting of polyethylene, ethylene copolymers, polypropylene and polyvinylidene fluoride.

25. A method in accordance with claim 14 wherein said conductive polymer element comprises at least two layers of different conductive polymer compositions.

26. A method in accordance withh claim 25 wherein at least one of said layers comprises a conductive polymer composition having a positive temperature coefficient of resistance.

* * * * *